US008689388B1

(12) United States Patent
Morad et al.

(10) Patent No.: US 8,689,388 B1
(45) Date of Patent: Apr. 8, 2014

(54) APPARATUS TO REMOVE A DISPOSABLE SPONGE FROM A HAND OPERATED SQUEEZE SPONGE MOP WITHOUT HAVING TO TOUCH THE SPONGE

(71) Applicants: Fred I. Morad, Toluca Lake, CA (US); William P. Camp, Jr., Vanlue, OH (US)

(72) Inventors: Fred I. Morad, Toluca Lake, CA (US); William P. Camp, Jr., Vanlue, OH (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 13/933,037

(22) Filed: Jul. 1, 2013

(51) Int. Cl.
*A47L 13/20* (2006.01)

(52) U.S. Cl.
USPC ..... 15/228; 15/244.1; 15/231

(58) Field of Classification Search
USPC ..... 15/116.2, 119.2, 228, 231, 244.1
See application file for complete search history.

(56) References Cited

U.S. PATENT DOCUMENTS 5,502,858 A * 4/1996 Hoagland et al. ..... 15/119.2
8,166,597 B2 * 5/2012 Levitt et al. ..... 15/118
8,296,895 B2 * 10/2012 Michelson et al. ..... 15/244.4
8,464,391 B2 * 6/2013 Bober et al. ..... 15/228
2008/0040877 A1 * 2/2008 Aiyar ..... 15/115
2008/0168612 A1 * 7/2008 Lee et al. ..... 15/119.2
2010/0101039 A1 * 4/2010 Cameneti et al. ..... 15/228
2010/0205758 A1 * 8/2010 Levitt et al. ..... 15/105
2012/0060313 A1 * 3/2012 Ko ..... 15/228

* cited by examiner

*Primary Examiner* — Monica Carter
*Assistant Examiner* — Michael Jennings
(74) *Attorney, Agent, or Firm* — Thomas I. Rozsa

(57) ABSTRACT

A hand operated butterfly sponge mop or regular sponge mop with a unique disposable sponge assembly where the sponge is retained by ratchet teeth respectively engaging a notch on a pair of notched collars molded onto the sponge. The sponge is retained in a closed position against the lower surface of the main body by ratchet teeth engaged in notches of a respective notched collar to overcome a force of downward force compression springs. When the respective button attached to a respective tooth is pressed down to overcome a biasing spring force which caused the teeth to be engaged with the notches, the downward spring force of the force compression springs cause the sponge to move away from the main body so that the dirty sponge falls away into a trash receptacle without requiring a user to handle the dirty sponge.

3 Claims, 12 Drawing Sheets

APPARATUS TO REMOVE A DISPOSABLE SPONGE FROM A HAND OPERATED SQUEEZE SPONGE MOP WITHOUT HAVING TO TOUCH THE SPONGE

BACKGROUND OF THE INVENTION

1. Field of the Invention

The present invention relates to the field of hand operated sponge squeeze mops which retain a sponge.

2. Description of the Prior Art

In general, various types of hand operated regular sponge mops or squeeze sponge mops are known in the prior art.

The hand operated regular sponge mop or squeeze sponge mop includes a generally rectangular-shaped main body having an upper or top surface which includes a handle receiving section which receives an elongated handle which is grasped by a user when operating the sponge mop and to which a sponge is retained on an underside of the main body. A rotatable squeeze section is hingeably attached to the main body and is pressed against the sponge to wring the sponged dry after it has been dipped in water with cleaning solution and used to clean or scrub a surface such as a dirty floor.

As described above, the main body also has a flat lower or bottom surface with a disposable cleaning sponge retained by a pair of spaced apart plastic bases molded into a top surface of the sponge, each plastic base retaining a threaded shaft which threaded shafts respectively extend through respective aligned openings in the main body and then each respective shaft is retained by respective mating fasteners such as a nut with a mating threaded interior opening by which the sponge is retained onto the main body.

One common problem with all prior art hand operated regular sponge mops and squeeze sponge mops is that when the sponge is very dirty after cleaning operations, the user must use at least one of his/her hands to grasp the dirty sponge after the retaining nuts are removed from their respective threaded shafts and remove the sponge from the regular sponge mop or squeeze sponge mop. Therefore, the user is exposed to the filth and dirt on the disposable sponge. There is a significant need for an improved apparatus which eliminates the requirement for a user to grasp the dirty sponge by hand when removing it from the regular sponge mop or squeezes sponge mop and replacing it.

SUMMARY OF THE INVENTION

The present invention is a hand operated squeeze sponge mop with a unique disposable sponge assembly where the sponge has a pair of collars retained on a surface molded onto the sponge. Each collar has a notch. Each collar is respectively retained in a housing on the main body of the squeeze mop which housings each respectively support a spring biased trigger mechanism which has an arm ending in a tooth which respectively engages a notch in a collar. Adjacent each collar are a pair of posts which respectively retain a compression force spring which is affixed at a spring top to a lower post on the underside of the main body. Each compression force spring exerts a downward force against the sponge. The sponge is retained in a closed position against the lower surface of the main body by a respective tooth of each respective trigger mechanism engaged in a respective notch of a respective notched collar to overcome the downward force of the force compression springs. When the respective trigger is pressed down to overcome a biasing spring force which caused the teeth to be engaged with the notches, the downward spring force of the force compression springs cause the sponge to move away from the main body so that the dirty sponge falls away into a trash receptacle without requiring a user to handle the dirty sponge.

It is an object of the present invention to provide a mechanism on a hand operated sponge mop including a standard sponge mop and a squeeze sponge mop which retains a sponge in a manner which enables the sponge after it has been used and become dirty to be released and fall into a trash receptacle without a user's hand touching the dirty cleaning sponge.

It is also an object of the present invention to provide a mechanism for a hand operated sponge mop which includes a spring force to push downwardly on the sponge to enable the dirty sponge to be separated from the engagement members which retain the cleaning sponge onto the main body of the sponge mop so that the connection is released, enabling the sponge to be released without requiring a human hand to touch a dirty sponge.

It is a further object of the present invention to provide ratchet teeth retaining members to prevent the force compression springs from causing the sponge to move downwardly to be discarded until the ratchet teeth retaining members are manually released.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
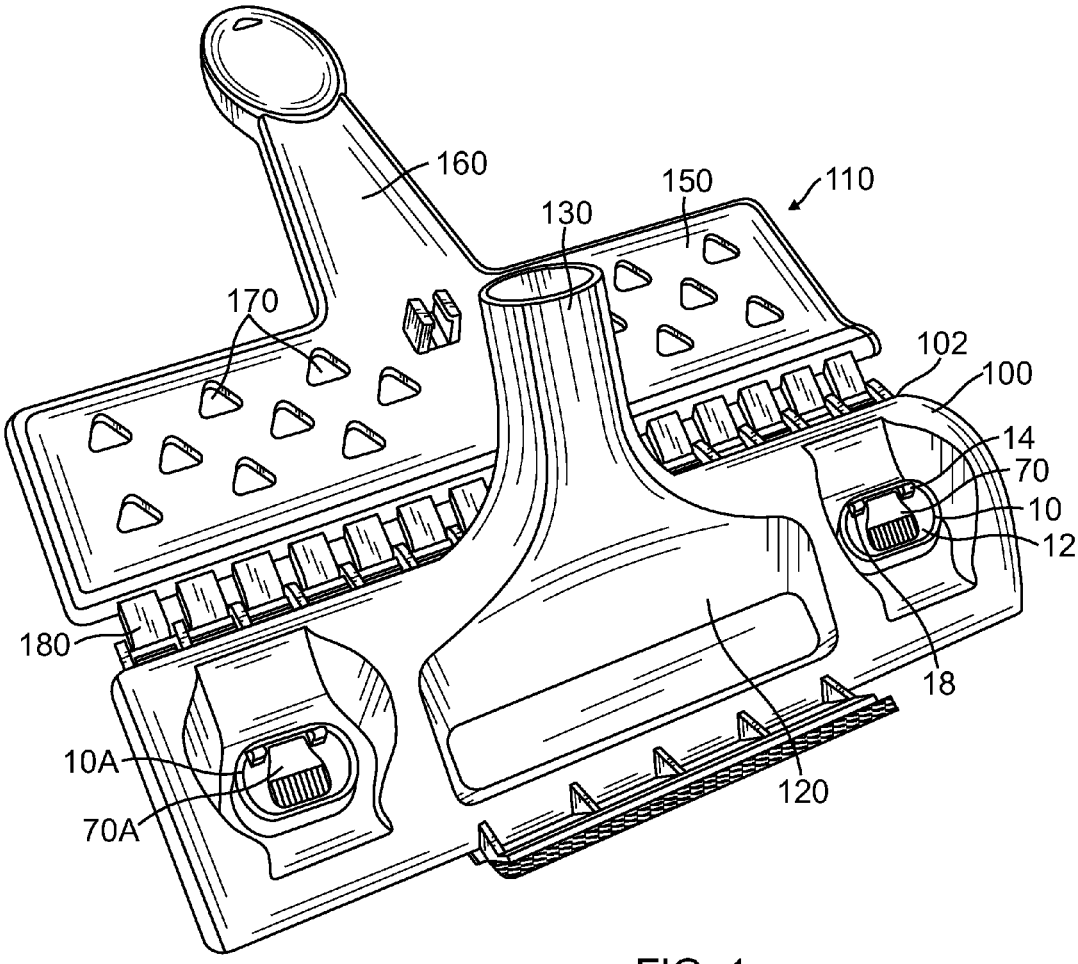
FIG. 1 is a top perspective view of the present invention main body of a hand operated squeeze sponge mop illustrating the retainer for a hand retaining assembly which retains a collar into which an elongated handle is retained, and a pair of housings for retaining the operational mechanisms of the present invention including a top perspective view of each trigger mechanism respectively retained on the top of a housing, also illustrating the hingeably attached squeeze member.
Figure 2:
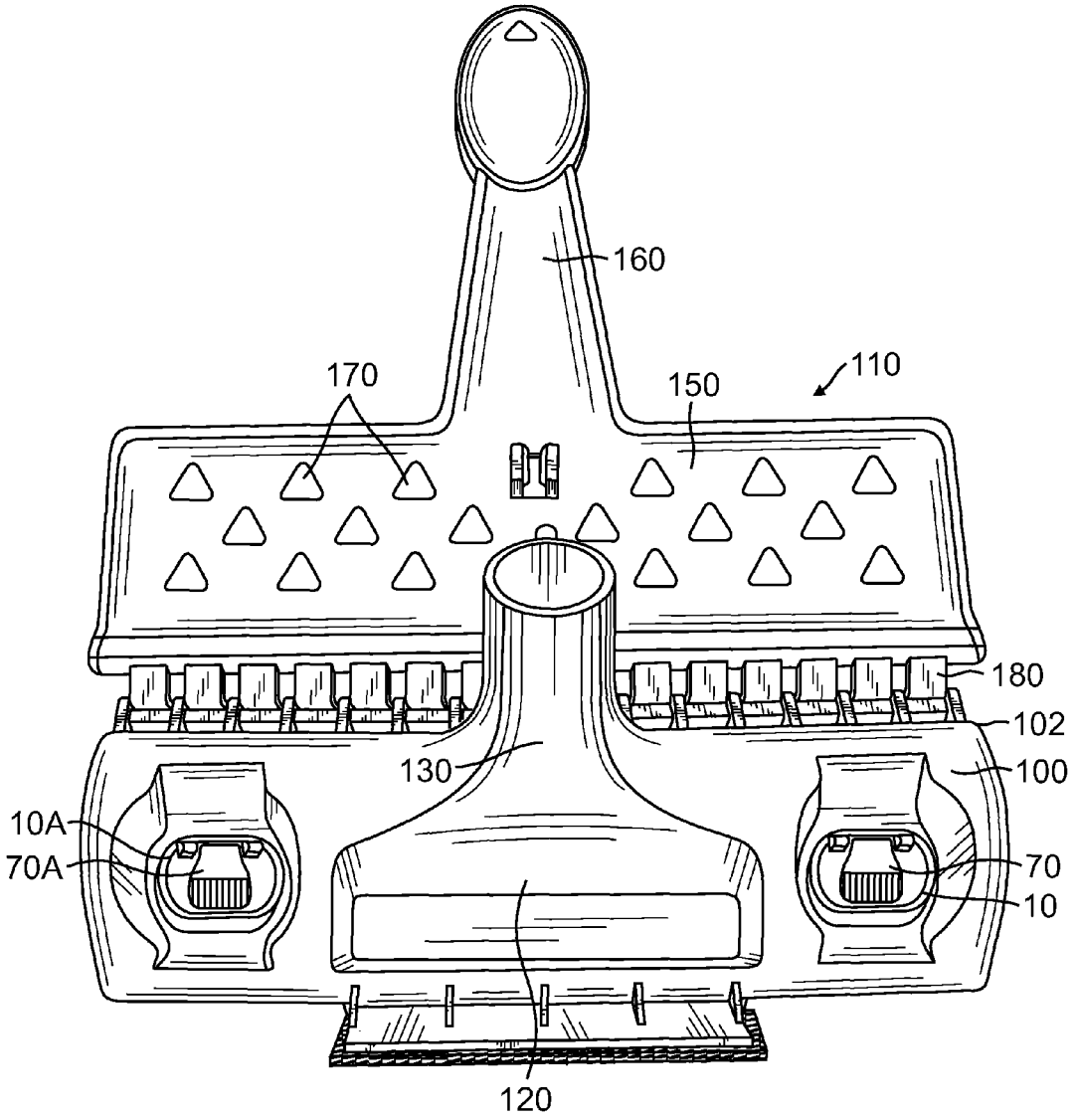
FIG. 2 is a top plan view of the present invention main body of a hand operated squeeze sponge mop illustrating the retainer for a hand retaining assembly which retains a collar into which an elongated handle is retained, and a pair of housings for retaining the operational mechanisms of the present invention including a top perspective view of each trigger mechanism respectively retained on the top of a housing, also illustrating the hingeably attached squeeze member.

Referring to FIG. 1 and FIG. 2, there is respectively illustrated a top perspective view and a top plan view of the present invention incorporated into a portion of the main body 100 of a hand operated squeeze sponge mop 110 illustrating a pair of housings 10 and 10A which respectively retain the operating mechanism of the present invention, also illustrating the top of a trigger mechanism 70 and 70A respectively retained on the top of each housing 10 and 10A and which trigger mechanism retains a notched collar as will be described. Illustrated in FIGS. 1 and 2 is a handle retaining member 120 affixed to the main body 100, the handle retaining member including a collar 130 into which an elongated handle (not shown) is retained. Also illustrated is a squeeze member 150 having a handle 160 and a multiplicity of openings 170, the squeeze member 150 rotatably attached by hinges 180 to a rear edge 102 of the main body 100.

Figure 3:
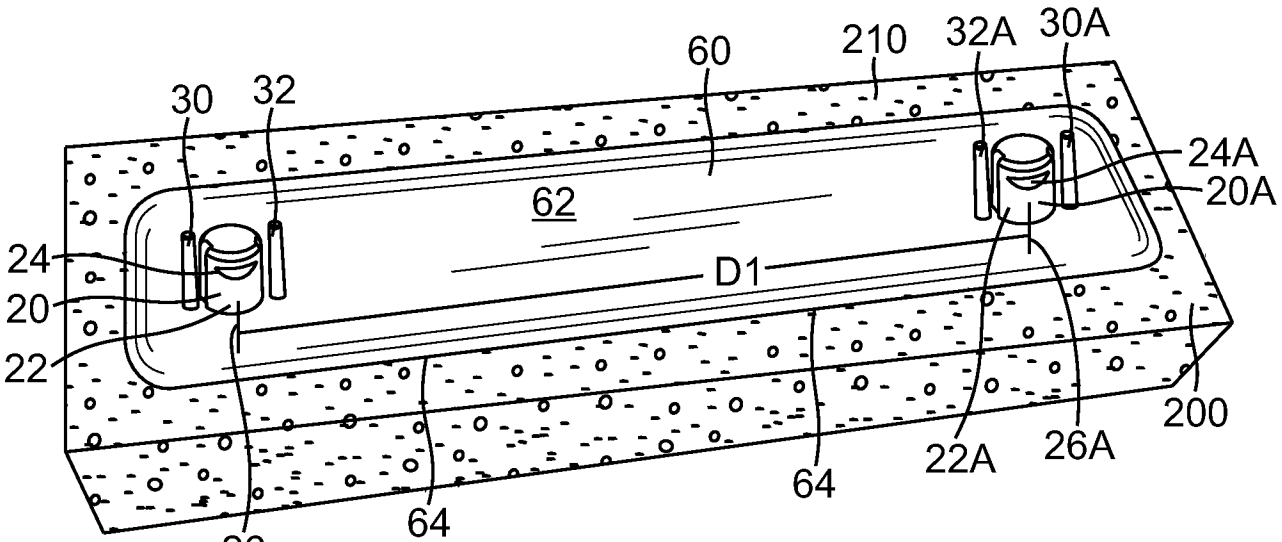
FIG. 3 is a rear top perspective view of a cleaning sponge with a surface attached onto the top surface of the sponge, the surface retaining a pair of oppositely disposed notched collars, each notched collar having pair of spring retaining posts on opposite sides of each notched collar.

Referring to FIG. 3, there is illustrated a rear top perspective view of a cleaning sponge 200 with a surface member 60 attached onto the top surface 210 of the sponge 200. The surface member 60 retains a pair of oppositely disposed notched collars 20 and 20A. Each notched collar 20 and 20A includes an exterior surface 22 and 22A which respectively contain a notch or tooth receiving member 24 and 24A. Each notched collar 20 and 20A has a pair of spring retaining pins 30 and 32 on opposite sides of notched collar 30 and 30A and 32A on opposite sides of notched collar 20A. The spring retaining pins 30, 32, 30A and 32A are also retained in surface member 60.

Notched collar 20 and spring retaining pins 30 and 32 extend perpendicularly to the top surface 62 of surface member 60. Notched collar 20A and spring retaining pins 30A And 32A extend perpendicularly to the top surface 62 of surface member 60. The centerline 26 of notched collar 20 and the centerline 26A of notched collar 20A are separated by a given distance "DI" The underside 64 of surface member 60 is fused by high heat or otherwise permanently attached to the top surface 210 of sponge 200.

While surface member 60 is illustrated as one piece, it is also within the spirit and scope of the present invention for the surface member to be formed into two pieces, one piece retaining notched collar 20 and spring retaining pins 30 and 32 and a separate piece retaining notched collar 20A and spring retaining pins 30A and 32A.

Figure 4:
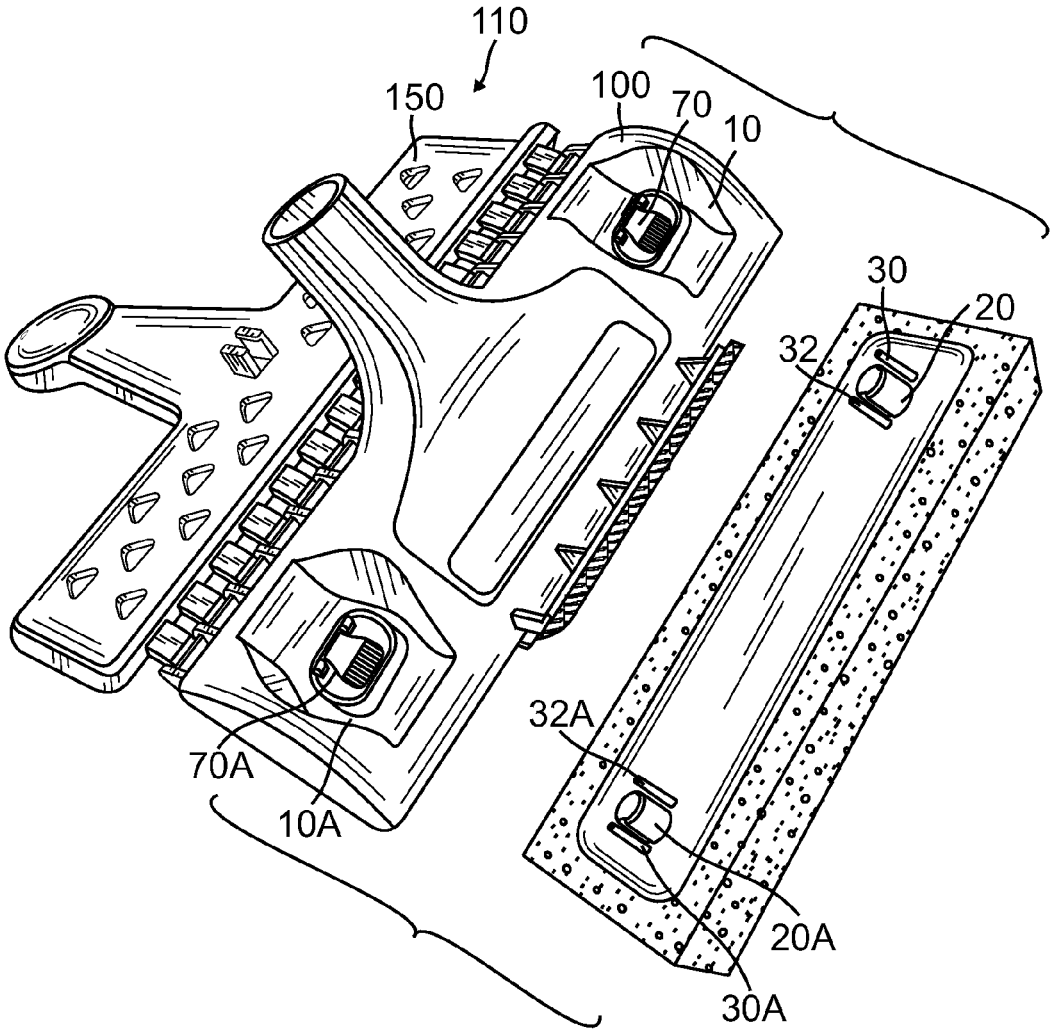
FIG. 4 is an exploded view including a top perspective view of the present invention main body of a hand operated squeeze sponge mop illustrating the retainer for a hand retaining assembly which retains a collar into which an elongated handle is retained, and a pair of housings for retaining the operational mechanisms of the present invention including a top perspective view of each trigger mechanism respectively retained on the top of a housing, also illustrating the hingeably attached squeeze member and a front top perspective view of a cleaning sponge with a surface attached onto the top surface of the sponge, the surface retaining a pair of oppositely disposed notched collars with the notches on the opposite sides of the collars as illustrated in FIG. 3, each notched collar having pair of spring retaining posts on opposite sides of each notched collar, with the sponge assembly removed from the main body.

Referring to FIG. 4, there is illustrated an exploded view including a top perspective view of the main body 100 of the hand operated squeeze sponge mop 110 and the squeeze member 150 hingeably attached to the main body 100 as previously described. FIG. 4 illustrates a front view notched collar 20 and spring retaining pins 30 and 32 aligned with housing 10 and notched collar 20A and spring retaining pins 30A and 32A aligned with housing 10A.

Figure 5:
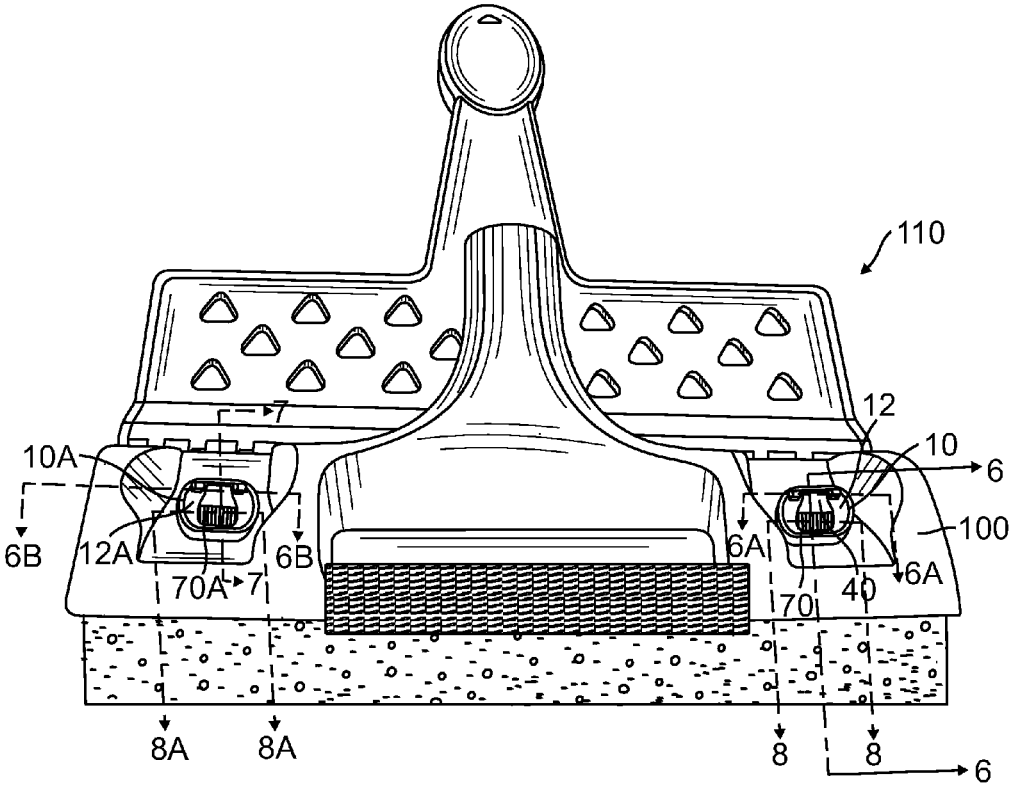
FIG. 5 is a front perspective view of the present invention main body of a hand operated squeeze sponge mop illustrating the retainer for a hand retaining assembly which retains a collar into which an elongated handle is retained, and a pair of housings for retaining the operational mechanisms of the present invention including a top perspective view of each trigger mechanism respectively retained on the top of a housing, also illustrating the hingeably attached squeeze member with sponge retained onto the main body.

Referring to FIG. 5, there is illustrated a front perspective view of the present invention main body 100 of the hand operated squeeze sponge mop 110 illustrating the retainer for a hand retaining assembly which retains a collar into which an elongated handle is retained, and a pair of housings 10 and 10A for retaining the operational mechanisms of the present invention including a top perspective view of each trigger mechanism 70 and 70A respectively retained on the tops 12 and 12A of housings 10— and 10A, also illustrating the hingeably attached squeeze member with sponge retained onto the main body in the engaged or retained condition.

Figure 6:
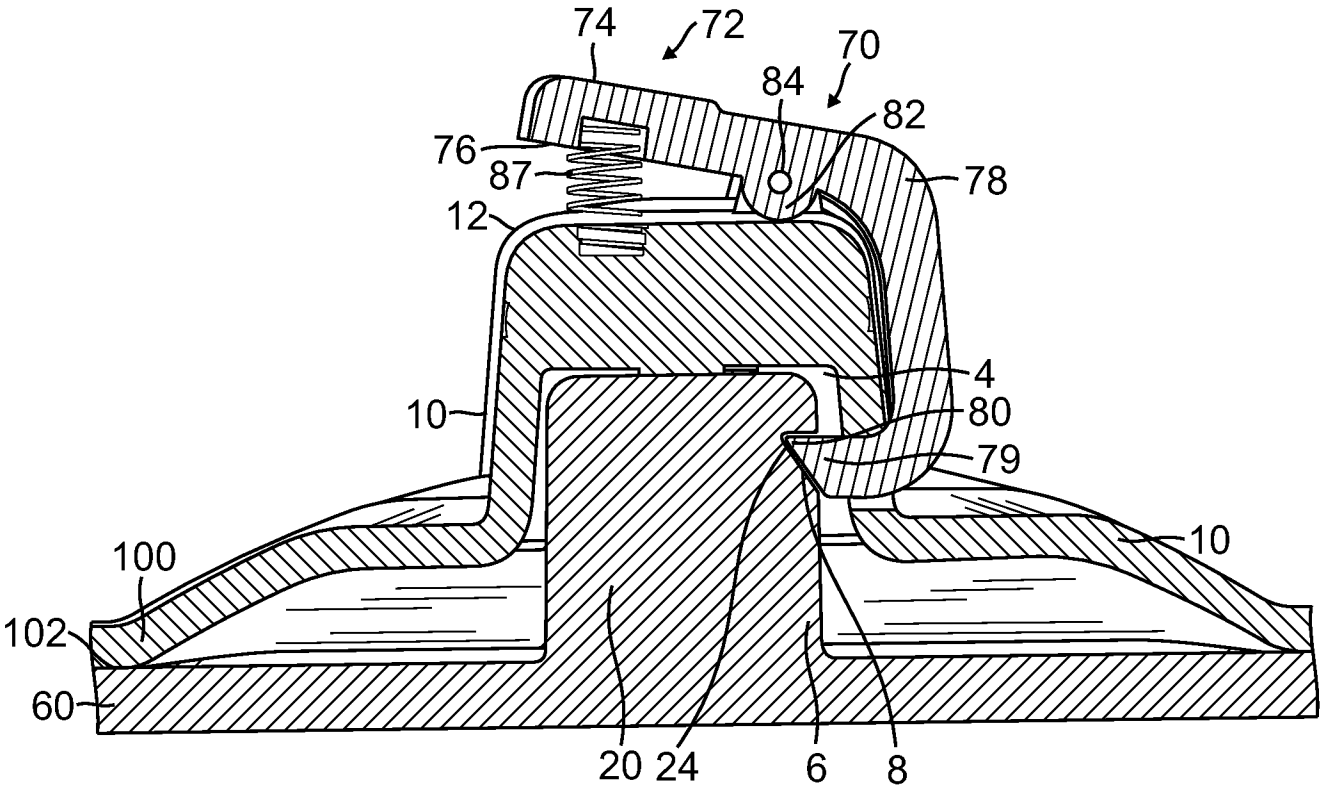
FIG. 6 is a cross-sectional view taken along line 6-6 of FIG. 5.

FIG. 6 is a cross-sectional view taken along line 6-6 of FIG. 5 to illustrate a portion of the operating mechanism of the present invention. Trigger mechanism 70 includes a press button 72 having a top surface 74 and a bottom surface 76, an arcuate bent arm 78 extending from the press button 72 and terminating in a tooth 80 at the distal end 79 of arm 78. The bent arm 78 also includes a pivot collar 82 with an opening 84 extending through the entire thickness of the pivot collar 82.

Figure 6A:
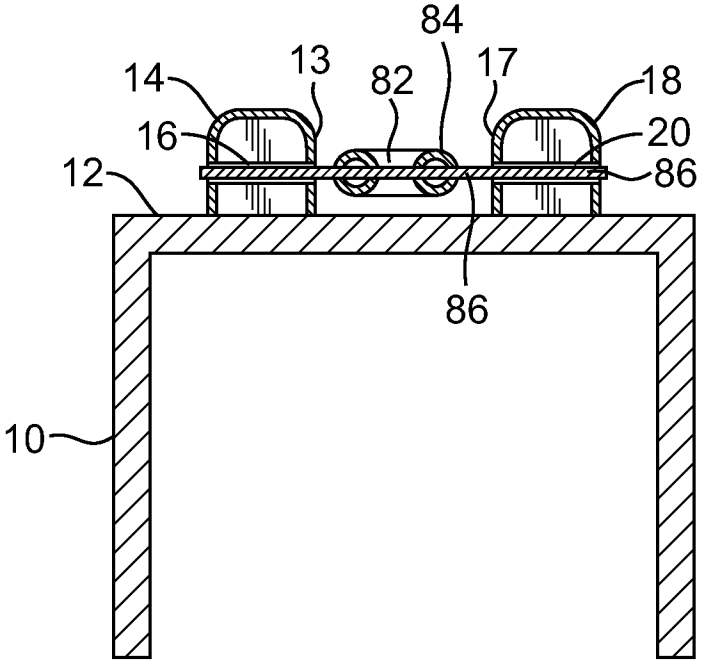
FIG. 6A is a cross-sectional view taken along line 6A-6A of FIG. 5.

Referring to FIGS. 6 and 6A, housing 10 has a top surface 12 to which is affixed a pair of parallel posts 14 and 18 which extends perpendicularly to the top 12 of housing 10, each post 14 and 18 has a respective transverse openings 16 and 20 extending from a respective interior surface 13 and 17 of respective posts 14 and 18, the openings 16 and 20 are aligned. The trigger mechanism 70 is rotatably affixed to the housing 10 by a pivot pin 86 which extends through opening 84 in pivot collar 82 and extends into respective openings 16 and 20 in posts 14 and 18. A biasing spring 87 is affixed at one end to the bottom surface 76 of press button 72 and affixed at its opposite end to the top surface 12 of housing 10. The housing also has an opening 8 in wall 6.

Notched collar 20 extends into an interior opening 4 in housing 10. The tooth 80 of trigger mechanism 70 extends through opening 8. The upward force of the biasing spring to be discussed causes tooth 80 to engage notch 24 in collar 20. In this engaged condition the collar 20 and plate member 60 which is affixed to the sponge is retained against the bottom surface 102 of main body 100 and overcomes the downward force of force springs 90 and 92.

Figure 6B:
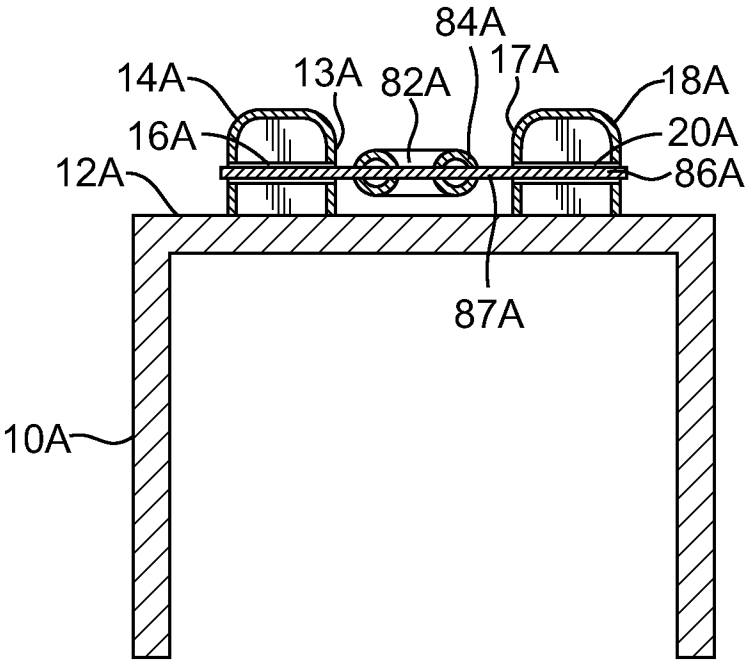
FIG. 6B is cross-sectional view taken along line 6B-6B of FIG. 5.
Figure 7:
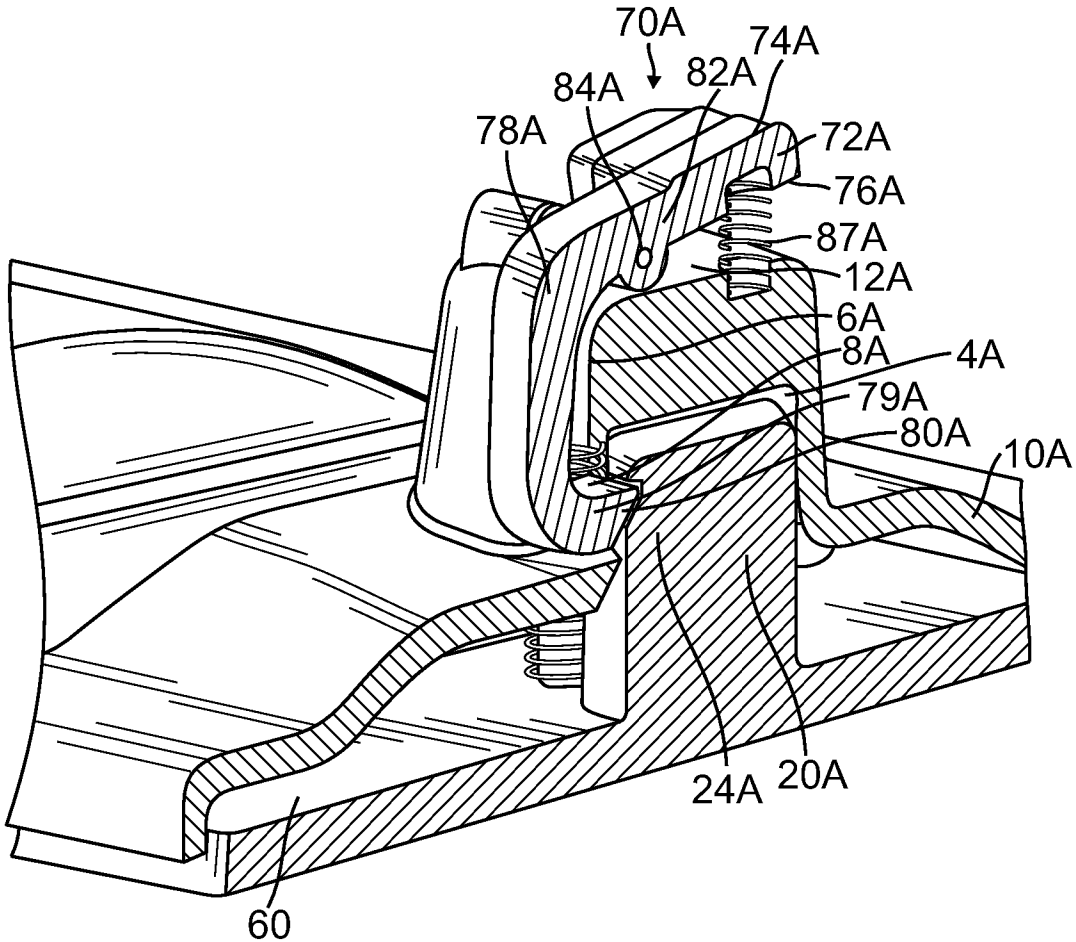
FIG. 7 is a rear cutaway view taken along line 7-7 of FIG. 5, with the view rotated 180 degrees counterclockwise to more clearly illustrate the trigger and tooth mechanism.

As also shown in FIGS. 7 and 6B, the housing 10A retains notched collar 20A by the identical trigger mechanism affixed to posts 14A and 18A. FIG. 7 is a cut away perspective-section taken along line 7-7 of FIG. 5. Trigger mechanism 70A includes a press button 72A having a top surface 74A and a bottom surface 76A, an arcuate bent a in 78A extending from the press button 72A and terminating in a tooth 80A at the distal end 79A of arm 78A. The bent arm 78A also includes a pivot collar 82A with an opening 84A extending through the entire thickness of the pivot collar 82A.

As shown in FIG. 6B, housing 10A has a top surface 12A to which is affixed a pair of parallel posts 14A and 18A which extend perpendicularly to the top 12A of housing 10A, each post 14A and 18A has a respective transverse opening 16A and 20A extending from a respective interior surfaced 13A and 17A of respective posts 14A and 18A, the openings 16A and 20A are aligned. The trigger mechanism 70A is rotatably affixed to the housing 10A by a pivot pin 86A which extends through opening 84A in pivot collar 82A and extends into respective openings 16A and 20A in posts 14A and 18A. As shown in FIG. 7, a biasing spring 87A is affixed at one end to the bottom surface 76A of press button 72A and affixed at its opposite end to the top surface 12A of housing 10A. The housing also has an opening 8A in wall 6A.

Notched collar 20A extends into an interior opening 4A in housing 10A. The tooth 80A of trigger mechanism 70A extends through opening 8A. The upward force of the biasing spring 87A causes tooth 80A to engage notch 24A in collar 20A. In this engaged condition the collar 20A and plate member 60 which is affixed to sponge 200 are retained against the bottom surface 102 of main body 100.

Figure 8:
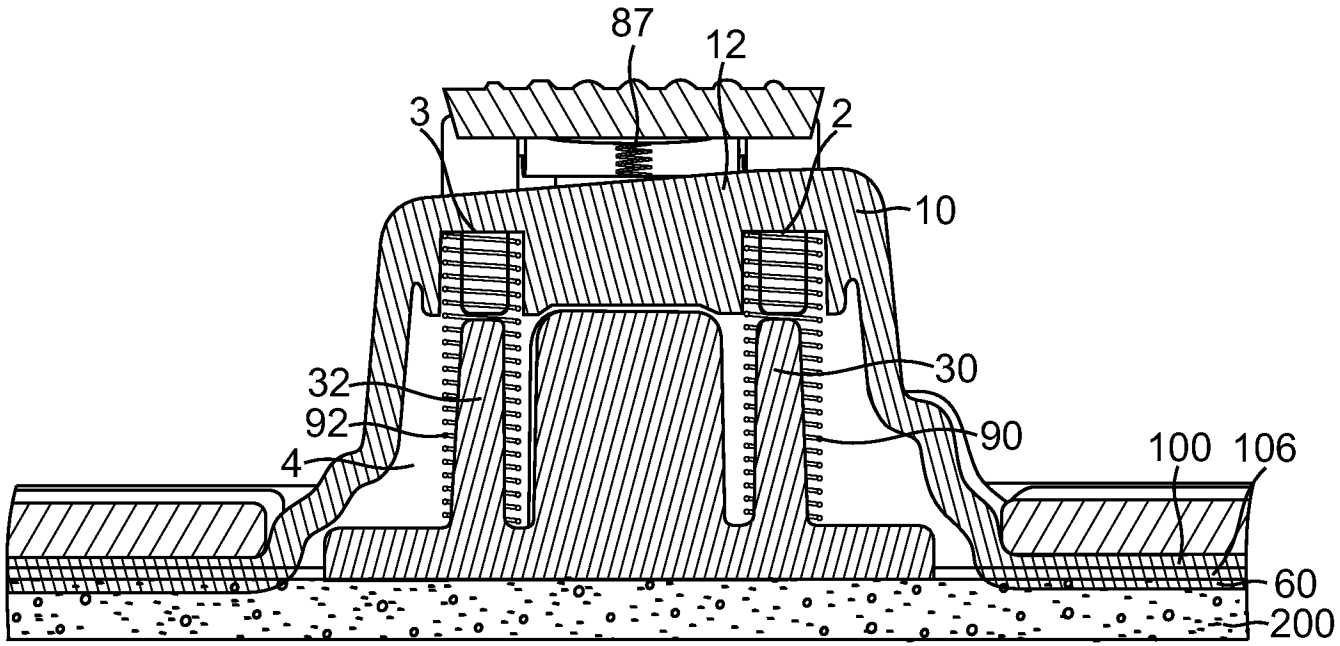
FIG. 8 is a cross-sectional view taken along line 8-8 of FIG. 5 showing the sponge in the retained condition in housing 10.
Figure 8A:
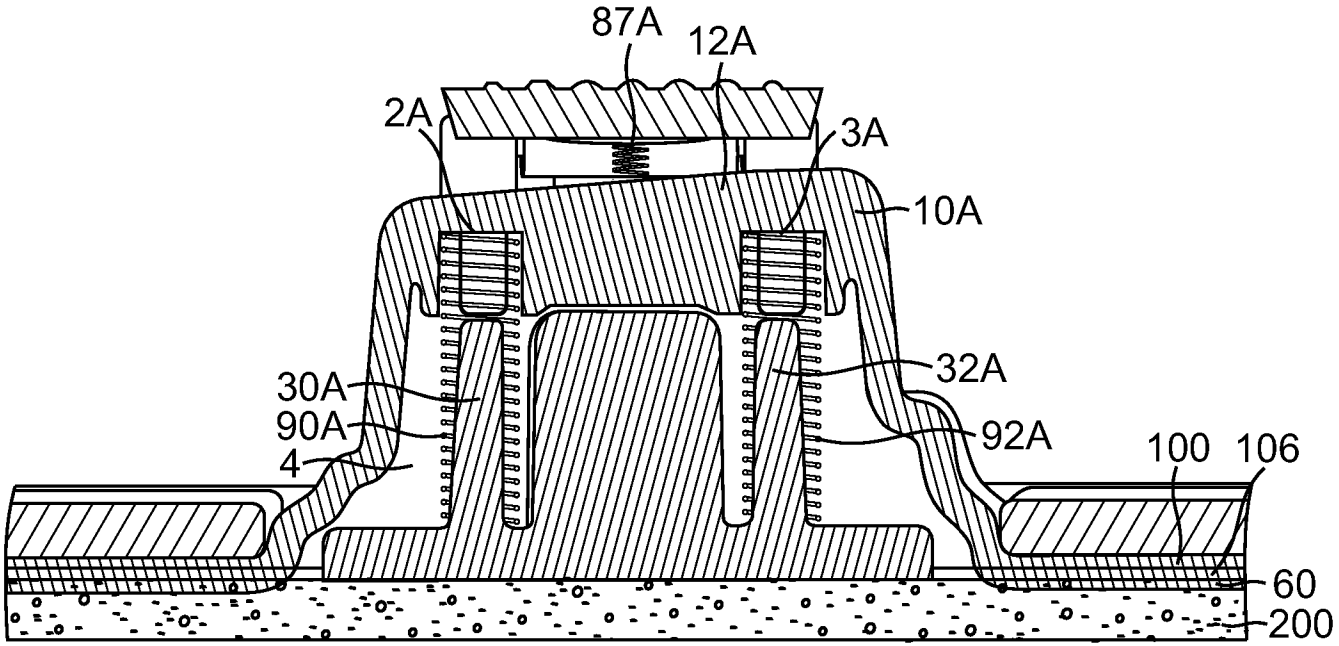
FIG. 8A is a cross-sectional view taken along line 8A-8A of FIG. 5 showing the sponge in the retained condition in housing 10A.

FIG. 8 is a cross-sectional view taken along line 8-8 of FIG. 5 with tooth 80 of a spring biased trigger mechanism 70 engaging a notch 24 in a notched collar 10 as illustrated in FIG. 6. Force compression spring 90 is retained on pin 30 and retained within opening 4 of collar 10 by upper post 2. Force compression spring 92 is retained on pin 32 and retained within opening 4 of collar 10 by upper post 3. With the trigger mechanism 70 as illustrated in FIGS. 6 and 8, the downward force of the compression springs 90 and 92 is overcome by the biasing spring 86 causing tooth 80 to engage notch 24 in notched collar 10. As illustrated, the sponge 200 is retained against the underside 106 of main body 100. FIG. 8A is a cross-sectional view taken along Line 8A-8A from FIG. 5 with the tooth 80A of a spring biased trigger mechanism 70A engaging the notch 24A in the notched collar 10A as illustrated in FIG. 7. Force compression spring 90A is retained on pin 30A and retained within opening 4 of collar 10 by upper post 2A. Force compression spring 92A is retained on pin 32A and retained within opening 4 of collar 10A by upper post 3A. With the trigger mechanism 70A as illustrated in FIGS. 7 and 8A, the downward force of the compression springs 90A and 92A is overcome by the biasing spring 86A causing tooth 80A to engage notch 24A in notched collar 10A.

Cleaning is then performed until the sponge is wet and dirty and water is wrung out of the sponge 200 by squeeze member rotated to press sponge 200 against the underside 106 of main body 100 with water flowing through openings. The sponge 200 is once against dipped in cleaning water and the cleaning operation continues. When the sponge 200 becomes so dirty that the dirty sponge 202 has to be replaced, the present invention is further utilized.

Figure 9:
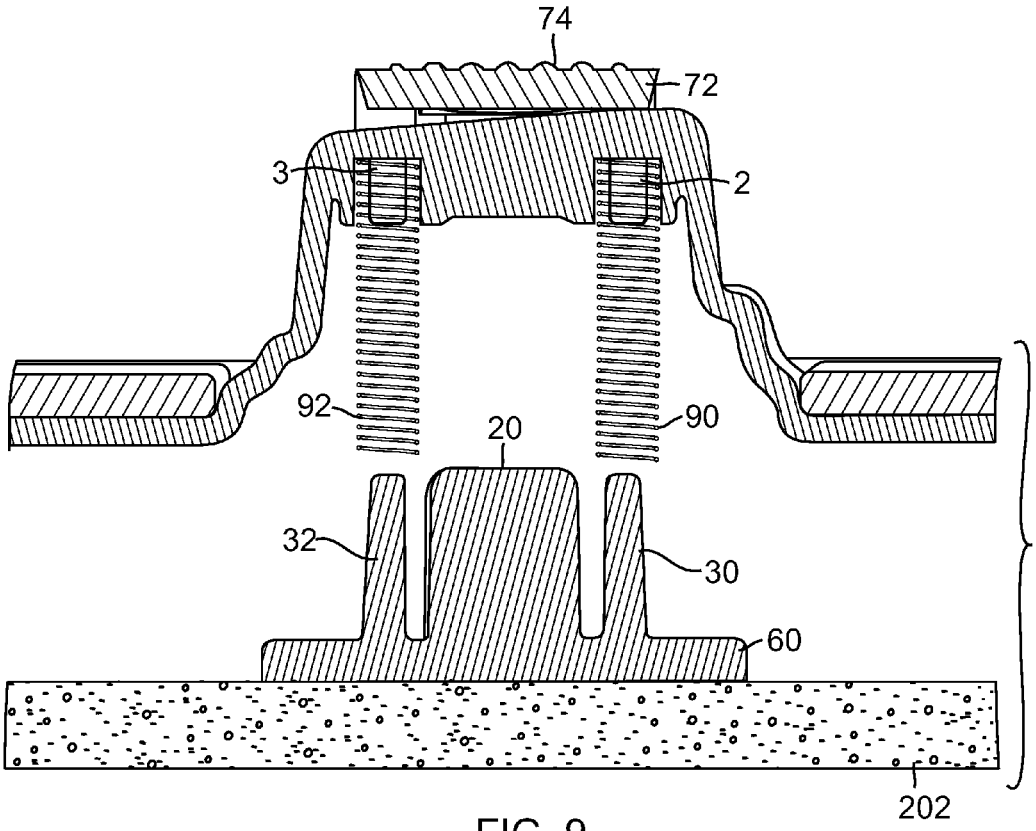
FIG. 9 is a cross-sectional view taken from FIG. 8 but showing the trigger mechanism released so that the sponge retaining plate pins and collar are moving away from the underside of the plate and are released to be disposed of in the trash.

Referring to FIG. 9, when a downward force such as from a finger is exerted on top surface 74 of press button 72 to overcome the force of biasing spring 86, the trigger mechanism 70 rotates about pivot collar 82 and tooth 80 is disengaged from notch 24 of notched collar 20. Similarly, referring to FIG. 9A, when a downward force is exerted on top surface 74A of press button 72A to overcome the force of biasing spring 86A, the trigger mechanism 70A rotates about pivot collar 82A and tooth 80A is disengaged from notch 24A of notched collar 20A.

Figure 9A:
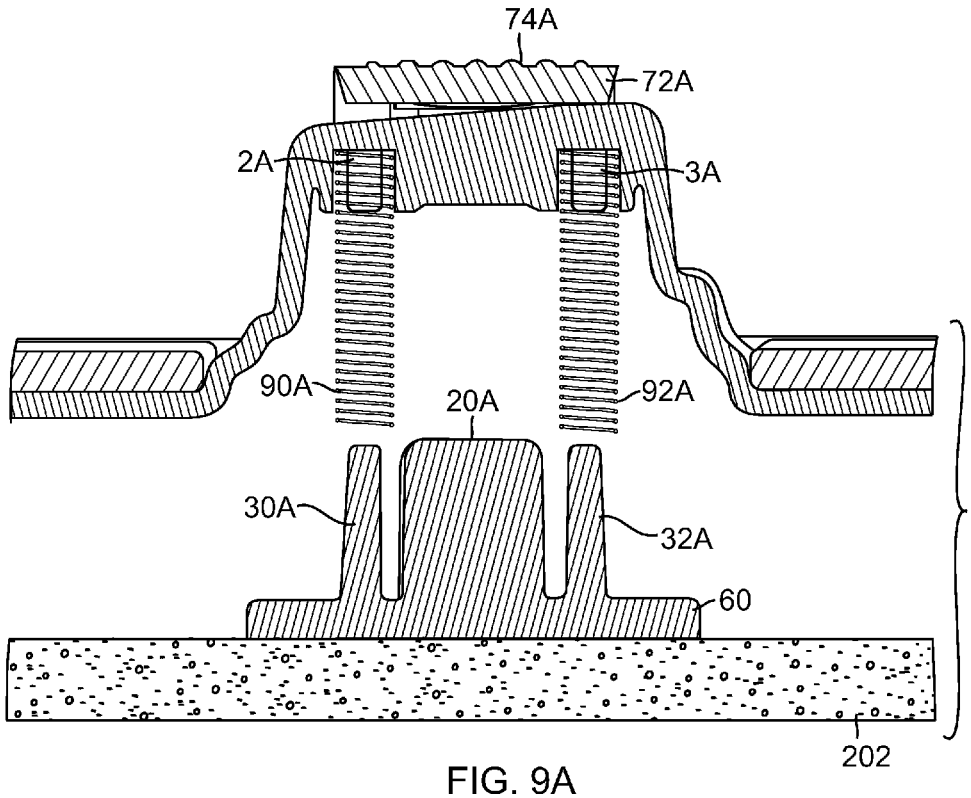
FIG. 9A is a partial cross-sectional view taken from FIG. 8A but showing the trigger mechanism released so that the sponge retaining plate pins and collar are moving away from the underside of the plate and are released to be disposed of in the trash.

Therefore, referring to FIGS. 9 and 9A, as a result of the downward force of the compression springs now being free to act, the downward force from compression springs 90 and 90A exert a downward force on press plate 60 and dirty sponge 202 and therefore, collar 20, pins 30 and 32, plate 60 and dirty sponge 202 are pushed away from the underside 106 of main body 100 and in addition, the force of compression springs 90A and 92A exert a downward force on plate 60 and sponge 202 and therefore, pins 30A and 32A and collar 10A, plate 60 and dirty sponge 202 are also pushed away from the underside 106 of main body 100 and therefore, the sponge and the attachments are discarded, leaving only the main body and force compression springs 30, 32, 30A and 32A retained on respective posts 2, 3, 2A and 3A within the main body 10 and 10A respectively. As a result, a hand does not have to touch the sponge in order for the sponge to be released and discarded into a trash receptacle, with a new sponge assembly consisting of a new sponge, new plate, new notched collars and new pins to retain the springs is reinserted and affixed as previously discussed.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A hand operated squeeze sponge mop including a main body comprising:

a. a first hollow housing having a top surface and sidewalls with an opening in one of the sidewalls and a spaced apart second housing having a top surface and sidewalls with an opening in one of the sidewalls, the first and second housing affixed to a top surface of the main body and the main body and bottom of the first and second housings each having aligned openings from which access is gained into each hollow interior of each respective housing;

b. a cleaning sponge with a surface plate attached onto a top surface of the sponge, the surface plate retaining a first and second oppositely disposed notched collars each having a vertical center line, the first and second notched collars separated by a given distance from their respective vertical center lines, the first and second notched collar each including an exterior surface which respectively contain a tooth receiving notch, the first and second notched collar each having a pair of spring retaining pins on opposite sides of the first and second notched collar, the first and second notched collar and each pair of spring retaining pins are retained in the surface plate and extend perpendicularly to a top surface of the surface plate, a bottom surface of the surface plate permanently attached to the top surface of sponge;

c. the sponge retained against the undersurface of the main body so that the first notched collar and first pair of retaining pins are aligned with the opening in the bottom surface of the first housing and fit within the hollow interior of the first housing and the second notched collar and second pair of retaining pins are aligned with the opening in the bottom of the second housing and fit within the hollow interior of the second housing;

d. a first trigger mechanism including a press button having a top surface and a bottom surface, an arcuate bent arm extending from the press button and terminating in a tooth at a distal end of the bent arm which also includes a pivot collar with an opening extending through the pivot collar, the first housing having a top surface to which is affixed a pair of parallel posts which extending perpendicularly to the top surface of the first housing, each post having a respective transverse opening extending from a respective interior surface of a respective post, the openings are aligned, a first biasing spring is affixed at one end to the bottom surface of the press button and affixed at its opposite end to the top surface of the first housing, the first trigger mechanism is rotatably affixed to the housing by a first pivot pin which extends through the opening in the pivot collar and extends into respective openings in the parallel posts;

e. the first notched collar extends into the interior opening in first housing, the tooth of first trigger mechanism extends through the opening in a sidewall of the first housing, an upward force of the first biasing spring causing the tooth to engage a tooth receiving notch in the first notched collar;

f. a second trigger mechanism including a press button having a top surface and a bottom surface, an arcuate bent arm extending from the press button and terminating in a tooth at a distal end of the bent arm which also includes a pivot collar with an opening extending through the pivot collar, the second housing having a top surface to which is affixed a pair of parallel posts which extend perpendicularly to the top surface of the second housing, each post having a respective transverse opening extending from a respective interior surface of a respective post, the openings are aligned, a second biasing spring is affixed at one end to the bottom surface of the press button and affixed at its opposite end to the top surface of the second housing, the second trigger mechanism is rotatably affixed to the second housing by a second pivot pin which extends through the opening in the pivot collar and extends into respective openings in the parallel posts;

g. the second notched collar extends into the interior opening in second housing, the tooth of second trigger mechanism extends through the opening in a sidewall of the second housing, an upward force of the second biasing spring causes the tooth to engage a tooth engaging notch in the second notched collar;

h. a first force compression spring is retained on one of the pair of pins on opposite sides of the first notched collar and a second force compression spring is retained on a second pin of the pair of pins on opposite sides of the first notched collar, the first force spring is retained within the interior opening of the first housing by a first upper post and the second force spring is retained within the interior opening of first housing by a second upper post; a third force compression spring is retained on a third pin and a fourth force compression spring is retained on a fourth pin of the pair of pins on opposite sides of the second notched collar, the third force spring is retained within the interior opening of the second housing by a third upper post and the fourth force spring is retained within the interior opening of the second housing by a fourth upper post; and i. with the respective tooth of the first and second trigger mechanism engaged in a respective tooth engaging member of the first and second collar, a downward force of the first, second, third and fourth compression springs is overcome by the respective biasing springs causing each respective tooth to engage a tooth engaging notch in the respective first and second notched collars and the sponge is retained against the underside of the main body, and when the sponge becomes dirty and has to be replaced, a downward force exerted on each top surface of each press button to overcome the force of each respective biasing spring, the first and second trigger mechanisms each rotate about its respective pivot collar so that each respective tooth is disengaged from the tooth engaging member in the first and second notched collars, then the downward force from first, second, third and fourth compression springs exert a downward force on the surface plate and the sponge so that the sponge and the attached surface plate are pushed away from the underside of the main body.

2. A hand operated squeeze sponge mop including a main body comprising:

a. a first hollow housing having a top surface and sidewalls with an opening in one of the sidewalls and a spaced apart second housing having a top surface and sidewalls with an opening in one of the sidewalls, the first and second housing affixed to a top surface of the main body and the main body and bottom of the first and second housings each having aligned openings from which access is gained into each hollow interior of each respective housing;

b. a cleaning sponge with at least one surface plate attached onto a top surface of the sponge, the at least one surface plate having retaining areas for retaining a first and second oppositely disposed collars separated by a given distance, the first and second collars each including an exterior surface which respectively contain a tooth receiving member, the first and second notched collar each having a spring retaining pins located adjacent the first and second collar, the first and second collar and spring retaining pins are retained in the at least one surface plate and extend perpendicularly to a top surface of the at least one surface plate, a bottom surface of the at least one surface plate permanently attached to the top surface of sponge;

c. the sponge retained against the undersurface of the main body so that the first collar and adjacent retaining pins are aligned with the opening in the bottom surface of the first housing and fit within the hollow interior of the first housing and the second collar and adjacent retaining pins are aligned with the opening in the bottom of the second housing and fit within the hollow interior of the second housing;

d. a first trigger mechanism rotatably mounted to the first housing, the first trigger mechanism having a first arm terminating in a first tooth at a distal end, the first trigger having a first biasing member;

e. the first collar extends into the interior opening in first housing, the tooth of first trigger mechanism extends through the opening in a sidewall of the first housing, a force of the first biasing spring causing the tooth to engage a tooth receiving member in the first collar;

f. a second trigger mechanism rotatably mounted to the second housing, the second trigger mechanism having a second arm terminating in a second tooth at a distal end, the second trigger mechanism having a second biasing member;

g. the second collar extends into the interior opening in second housing, the tooth of second trigger mechanism extends through the opening in a sidewall of the second housing, a force of the second biasing spring causing the tooth to engage a tooth receiving member in the second collar;

h. at least one first force compression spring is retained at one end within the interior opening of the first housing and is also supported at a second end on at least one pin adjacent the first collar and at least one second force compression spring is retained at one end within the interior opening of the second housing and is also supported at a second end on at least one pin adjacent the second collar; and i. with the respective tooth of the first and second trigger mechanism engaged in a respective tooth engaging member of the first and second collar, the biasing force on the trigger mechanism over comes a downward force from the force compression springs and the sponge is retained against the underside of the main body, and when the sponge becomes dirty and has to be replaced, a force exerted on each trigger to overcome the biasing spring force causes each tooth to be disengaged from a respective tooth engaging member in the first and second collars, so that the downward force on the at least one surface plate causes the sponge and attached at least one surface plate to be pushed away from the underside of the main body.

3. A hand operated sponge mop including a main body comprising:

a. a first hollow housing and a spaced apart second housing the first and second hollow housings affixed to a top surface of the main body and the main body and bottom of the first and second housings each having aligned openings from which access is gained into each hollow interior of each respective hollow housing;

b. a cleaning sponge with at least one surface plate attached onto a top surface of the sponge, the at least one surface plate having retaining areas for retaining a first and second oppositely disposed collars separated by a given distance, the first and second collars each including an exterior surface which respectively contain a tooth receiving member, the first and second notched collar each having a least one spring supporting pin located adjacent the first and second collar, the first and second collar and spring retaining pins are retained in the at least one surface plate and extend perpendicularly to a top surface of the at least one surface plate, a bottom surface of the at least one surface plate permanently attached to the top surface of sponge;

c. the sponge retained against the undersurface of the main body so that the first collar and adjacent retaining pins are aligned with the opening in the bottom surface of the first housing and fit within the hollow interior of the first housing and the second collar and adjacent retaining pins are aligned with the opening in the bottom of the second housing and fit within the hollow interior of the second housing;

d. a first trigger mechanism rotatably mounted to the first housing, the first trigger mechanism having a first arm terminating in a first tooth at a distal end, the first trigger having a first biasing member;

e. the first collar extends into the interior opening in first housing, the tooth of first trigger mechanism extends to a sidewall of the first housing, a force of the first biasing spring causing the tooth to engage a tooth receiving member in the first collar;

f. a second trigger mechanism rotatably mounted to the second housing, the second trigger mechanism having a second aim terminating in a second tooth at a distal end, the second trigger having a second biasing member;

g. the second collar extends into the interior opening in second housing, the tooth of second trigger mechanism extends to a sidewall of the second housing, a force of the second biasing spring causing the tooth to engage a tooth receiving member in the second collar;

h. at least one first force compression spring is retained at one end within the interior opening of the first housing and is also supported at a second end on at least one pin adjacent the first collar and at least one second force compression spring is retained at one end within the interior opening of the second housing and is also retained at a second end on at least one pin adjacent the second collar; and i. with the respective tooth of the first and second trigger mechanism engaged in a respective tooth engaging member of the first and second collar, the biasing force on the trigger mechanism over comes a downward force from the force compression springs and the sponge is retained against the underside of the main body, and when the sponge is to be replaced, a force exerted on each trigger to overcome the biasing spring force causes each tooth to be disengaged from a respective tooth engaging member in the first and second collars, so that the downward force on the at least one surface plate and the sponge causes the at least one surface plate and attached sponge to be pushed away from the underside of the main body.

* * * * *